US010688632B2

(12) United States Patent
Krasnik

(10) Patent No.: US 10,688,632 B2
(45) Date of Patent: Jun. 23, 2020

(54) STOP WRENCHES AND ADAPTORS FOR STOP VALVES

(71) Applicant: Scott Krasnik, Roseville, MI (US)

(72) Inventor: Scott Krasnik, Roseville, MI (US)

( * ) Notice: Subject to any disclaimer, the term of this patent is extended or adjusted under 35 U.S.C. 154(b) by 212 days.

(21) Appl. No.: 15/889,258

(22) Filed: Feb. 6, 2018

(65) Prior Publication Data

US 2019/0240814 A1 Aug. 8, 2019

(51) Int. Cl.
*B25B 13/50* (2006.01)
*B25B 23/00* (2006.01)
*B25B 13/46* (2006.01)

(52) U.S. Cl.
CPC ..... *B25B 13/50* (2013.01); *B25B 13/462* (2013.01); *B25B 13/5091* (2013.01); *B25B 23/0035* (2013.01)

(58) Field of Classification Search
CPC .. B25B 23/0035; B25B 13/50; B25B 13/5091
See application file for complete search history.

(56) References Cited

U.S. PATENT DOCUMENTS 1,420,701 A * 6/1922 Hoffman ..... B25B 13/5091 81/124.2
2,138,725 A * 11/1938 Brouhard ..... B25B 13/5091 81/119
4,542,666 A * 9/1985 White ..... B25B 13/50 81/119
5,287,775 A * 2/1994 Moore ..... B25B 13/5091 81/121.1
D557,088 S * 12/2007 Morgan ..... D8/29
7,788,995 B2 * 9/2010 Nicolazzo ..... B25B 13/48 81/124.2
8,347,762 B2 * 1/2013 Jones ..... B25B 13/5091 81/121.1
8,701,526 B2 * 4/2014 Scott ..... B25B 13/065 29/426.5
D823,082 S * 7/2018 McCutchen ..... D8/21
D825,299 S * 8/2018 Stalter ..... D8/21
D825,300 S * 8/2018 Stalter ..... D8/21
D825,301 S * 8/2018 Stalter ..... D8/29
D826,014 S * 8/2018 Stalter ..... D8/21
10,124,471 B2 * 11/2018 Sturner ..... B25G 1/10
2003/0217571 A1 * 11/2003 Turnau, III ..... F16K 35/06 70/175

* cited by examiner

*Primary Examiner* — David B. Thomas

(57) ABSTRACT

A stop wrench is provided and includes a handle receiver and a base. The handle receiver includes an outer wall and a back plate. The handle receiver is configured to receive a handle of a first stop valve within the outer wall. The handle abuts the back plate when fully in the handle receiver. The base is attached to the handle receiver and extends from the back plate. The base is configured to be rotated via a tool. Rotation of the base rotates the handle receiver, which in turn rotates the handle to open or close the first stop valve.

20 Claims, 16 Drawing Sheets

STOP WRENCHES AND ADAPTORS FOR STOP VALVES

FIELD

The present disclosure relates to stop valves in plumbing systems.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Stop valves (sometimes referred to as "shut-off valves" or "cut-off valves") are used, for example, under sinks, behind toilets and in a variety of other plumbing implementations to connect water supply systems to faucets, toilets, refrigerators, water filtration systems, dishwashers, etc. via water supply lines. The stop valves typically include an inlet that is often connected to a copper, polyvinyl chloride (PVC), iron, cross-linked polyethylene, or other type of water supply line and one or more outlets connected to braided or rigid supply lines. The inlets and outlets of the stop valves may be connected to various types of water supply lines. As another example, the water supply lines may be formed of plastic. There are various types of stop valves including straight stop valves, angled stop valves, multi-turn stop valves, quarter or half turn stop valves, etc.

There are two main categories of stop valves referred to as general purpose stop valves and tamper resistant stop valves. General purpose stop valves include a handle for opening and closing the stop valves. The handles are typically oval-shaped and/or have a shape similar to a cross-section of a prolate spheroid (or elongated sphere). The handles are held on to broach splines of stems of the stop valves via respective screws. The handles are used to turn the stems, which in turn opens and closes the stop valves.

The tamper resistant stop valves typically do not include a handle and require a special key or flat-head screw driver to open and close the valves. Tamper resistant stop valves are often used in hospitals, restaurants, hotels, businesses and/or other places to prevent unauthorized actuation of the stop valves.

Calcium build-up and/or corrosion can occur in stop valves over time, which causes the stop valves to stick and thus be difficult to open and close. As a result, it can be difficult to turn the handle of a general purpose stop valve and a key of a tamper resistant stop valve. To turn the handle of a general purpose stop valve, a pipe wrench, pliers or channel locks are often used in an attempt to turn the handle. The handles however are not designed to handle the torque that can be applied using a pipe wrench, pliers and channel locks, which results in the handles bending, deforming, breaking, stripping and becoming unusable. When this occurs, the handles and/or the entire stop valves need to be replaced.

SUMMARY

A stop wrench is provided and includes a handle receiver and a base. The handle receiver includes an outer wall and a back plate. The handle receiver is configured to receive a handle of a first stop valve within the outer wall. The handle abuts the back plate when fully in the handle receiver. The base is attached to the handle receiver and extends from the back plate. The base is configured to be rotated via a tool. Rotation of the base rotates the handle receiver, which in turn rotates the handle to open or close the first stop valve.

In other features, a stop wrench is provided and includes a handle receiver and a base. The handle receiver includes an outer wall and a back plate. The handle receiver is configured to be applied one-at-a-time on to different types of handles of different types of stop valves such that when applied to one of the handles, the one of the handles is disposed within a perimeter of the outer wall. The base is attached to the handle receiver and extends from a center of the back plate. The base is configured to be rotated via a tool. Rotation of the base rotates the handle receiver, which in turn rotates the handle to open or close the stop valve on which the handle receiver is applied.

In yet other features, a tamper resistant stop valve adaptor is provided and includes a body, a cylindrical key, and a broach spline. The cylindrical key is at one end of the body and is configured to receive a stem of a tamper resistant stop valve. The broach spline is at a second end of the body and is configured to mate with grooves and teeth in a stem adaptor. When the stem adaptor is rotated by a stop wrench, the cylindrical key is rotated by the stem adaptor and as a result rotates the stem of the tamper resistant stop valve to open or close the tamper resistant stop valve.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

and

Figure 30:
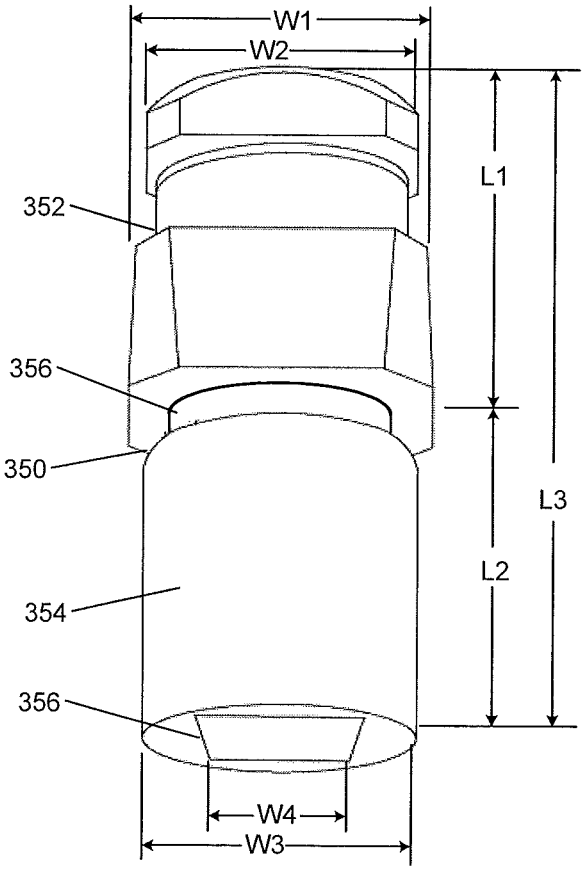

FIG. 30 is a perspective side view of a combined tamper resistant stop valve adaptor and stem adaptor;

In the drawings, reference numbers may be reused to identify similar and/or identical elements.

DETAILED DESCRIPTION

The examples set forth herein provide stop wrenches and corresponding adaptors for opening and closing general purpose stop valves and tamper resistant stop valves. The stop wrenches are configured to be received and/or be placed on handles of general purpose stop valves. Adaptors are disclosed for: connecting the stop wrenches on stems of the general purpose stop valves; connecting the stop wrenches to stems of taper resistant stop valves; and reducing gap(s) between edges of handles of general purpose stop valves and inner peripheral side walls of handle receivers of the stop wrenches. The examples allow for quick and easy opening and closing of stuck stop valves. The examples increase efficiency in operating stop valves and prevent damage to the stop valves during rotation of handles and/or stems of the stop valves. This includes preventing damage to the handles and eliminating repair and/or replacement costs of the handles and stop valves. The examples also reduce time and/or costs involved in plumbing installations and repairs.

Various examples are set forth herein. Some examples include example widths, depths, thicknesses and other measurements. These measurements are for example purposes only and may be different depending on the implementation and application.

Figure 1:
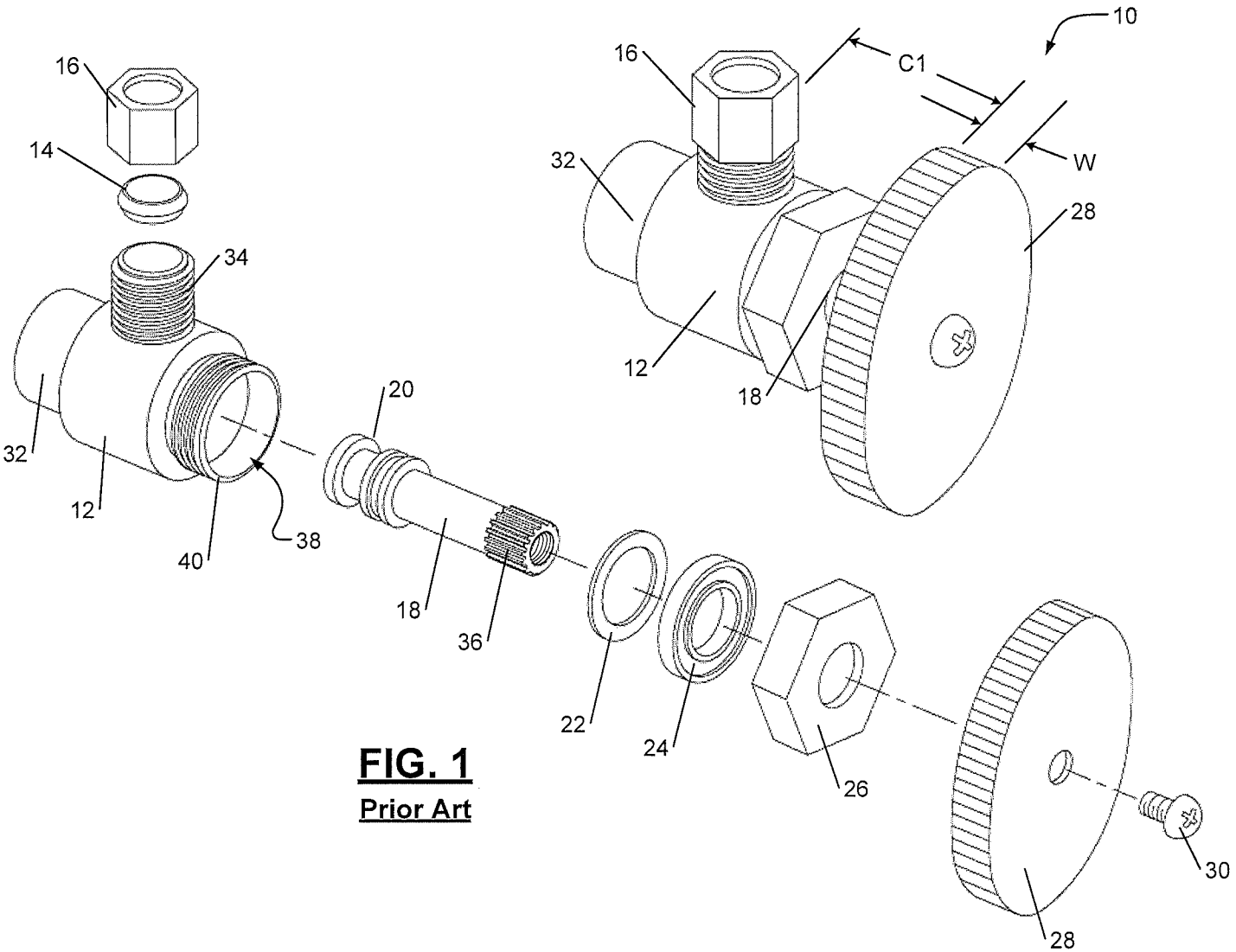
FIG. 1 Prior Art
FIG. 1 is a perspective view of an example of a traditional stop valve and corresponding components thereof.

FIG. 1 shows a traditional stop valve 10 and corresponding components thereof. The stop valve 10 includes a valve body 12, a ferrule 14, a compression (or supply) nut 16, a stem 18 with washer 20, a thrust washer 22, a packing 24, a bonnet (or packing nut) 26, a handle 28 and a screw 30. The valve body 12 has an inlet 32 and an outlet 34. The inlet 32, as shown, is configured to receive and be soldered to a copper pipe. The outlet 34 is configured to receive the ferrule 14 and the compression nut 16. The compression nut 16 is threaded on to the outlet 34. The stem 18 is inserted into an opening 38 of the valve body 12. The stem 18 includes a broach spline 36. The stem 18 receives the thrust washer 22, packing 24 and bonnet 26. The bonnet 26 is threaded onto a component receiving end 40 of the valve body 12. The handle 28 is fastened to the stem 18 via the screw 30.

Figure 2:
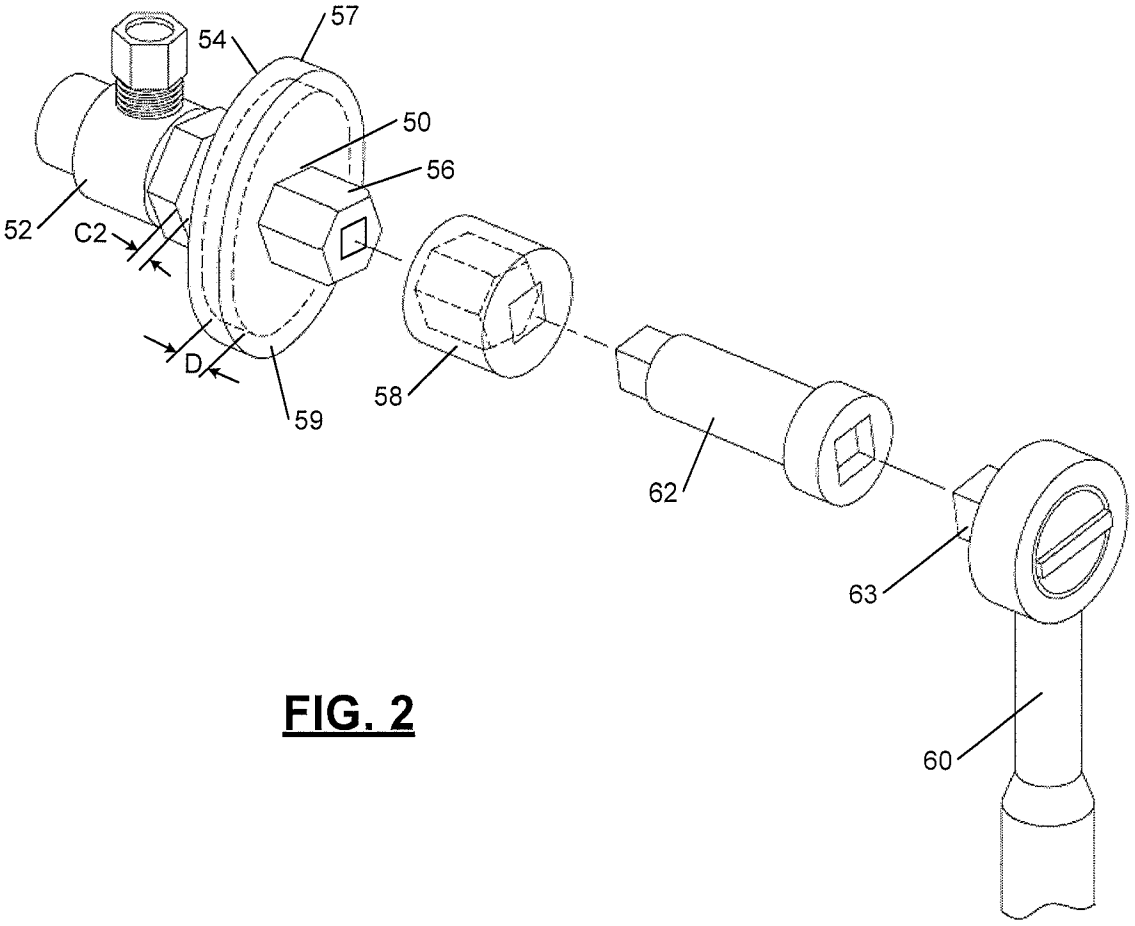
FIG. 2 is a perspective view of an example of a stop wrench on a stop valve in accordance with an embodiment of the present disclosure.
Figure 3:
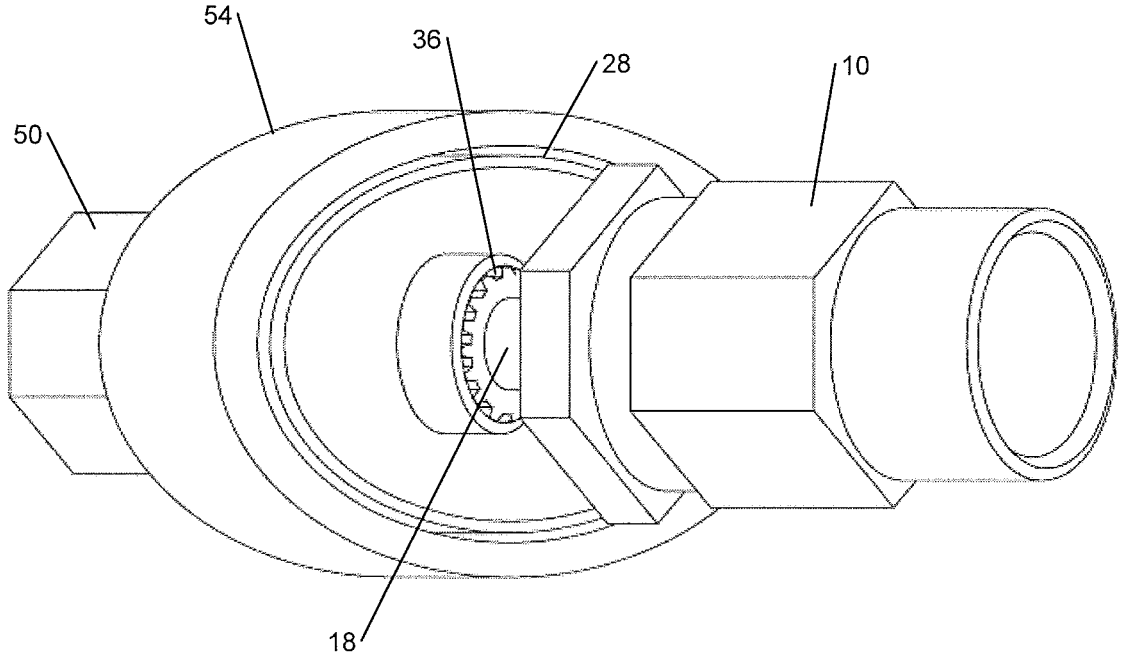
FIG. 3 is a perspective view of the stop wrench of FIG. 2 illustrating a handle of the stop valve in the stop wrench.
Figure 9:
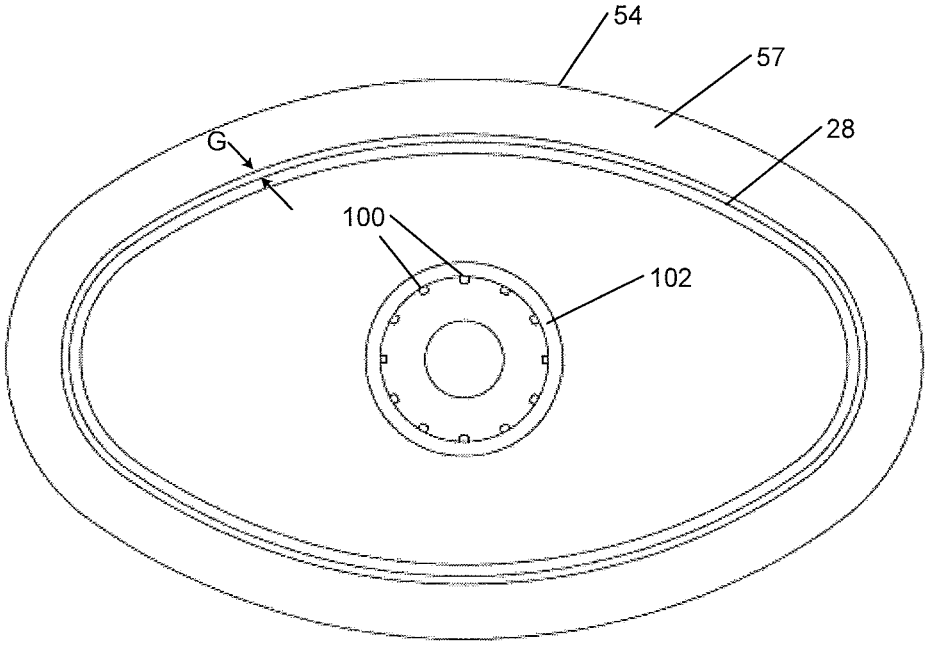
FIG. 9 is a perspective end view of a handle receiver of the stop wrench of FIG. 2 in which a handle of the stop valve is received.
Figure 10:
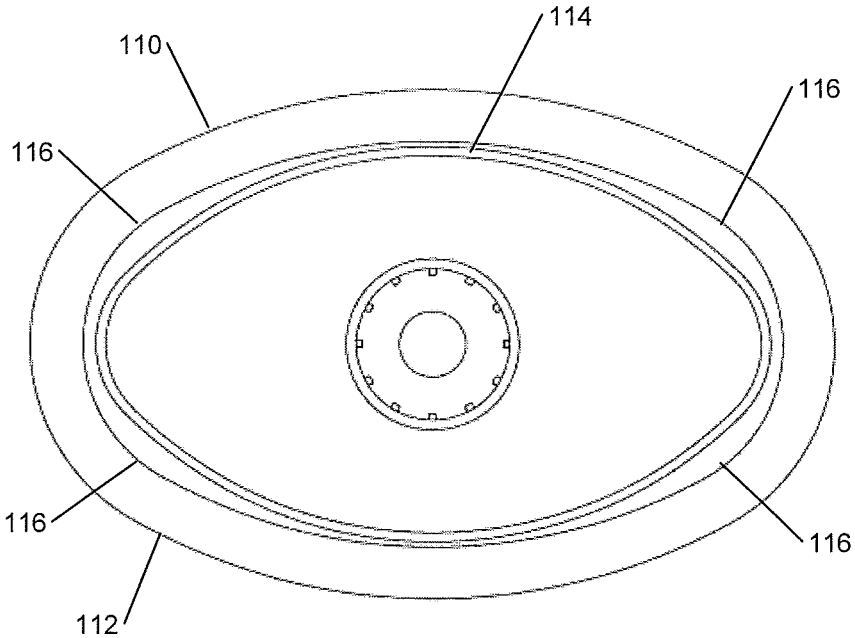
FIG. 10 is a perspective end view of an example of another stop wrench having a handle receiver applied on a handle of a stop valve is shown in accordance with another embodiment of the present disclosure.

FIG. 2 shows a stop wrench 50 applied on a stop valve 52. The stop wrench 50 includes a handle receiver 54 and a base (or shaft) 56. The handle receiver 54 (or handle receiving end) is "cup"-shaped and configured to receive and/or hold a handle of the stop valve 52. The handle receiver 54 may be shaped and configured to receive and/or hold different handles of various stop valves. There is a limited number of handles of stop valves that exist on the market. The handle receiver 54 may be shaped and/or configured to receive and/or hold any one or more of the stop valve handles existing on the market. For example, the handle receiver 54 may be sized to fit a handle of a particular size and/or may be oversized for other handles. Multiple handle receivers are disclosed herein. The handle receivers vary in shape from a an oval-shaped handle receiver with curved/rounded ends as shown in FIG. 10 to oval-shaped handle receivers with more pointed ends as shown in FIGS. 3 and 9. Although the base 56 is shown as being hexagonally-shaped, it may be circular-shaped.

FIG. 3 shows the handle receiver 54 being sized for a particular handle. FIG. 10 shows an example, of a handle receiver being oversized for a particular handle of a stop valve. In one embodiment, an inner depth D (an example of which is shown in FIG. 2) of the handle receiver 54 matches an overall width W (an example of which is shown in FIG. 1) of a handle. The handle receiver 54 includes an outer side wall 57 and a back plate 59 that extends (i) perpendicular to the outer side wall 57, and (ii) between the outer side wall 57 and the base 56. The outer side wall 57 is shown as an oval cylinder, where the outer and inner perimeters of the outer side wall 57 are shown as being oval-shaped rings. The shape of the outer side wall 57 and the shapes of the outer and inner perimeters of the outer side wall may have other shapes, as further disclosed herein.

Figure 11:
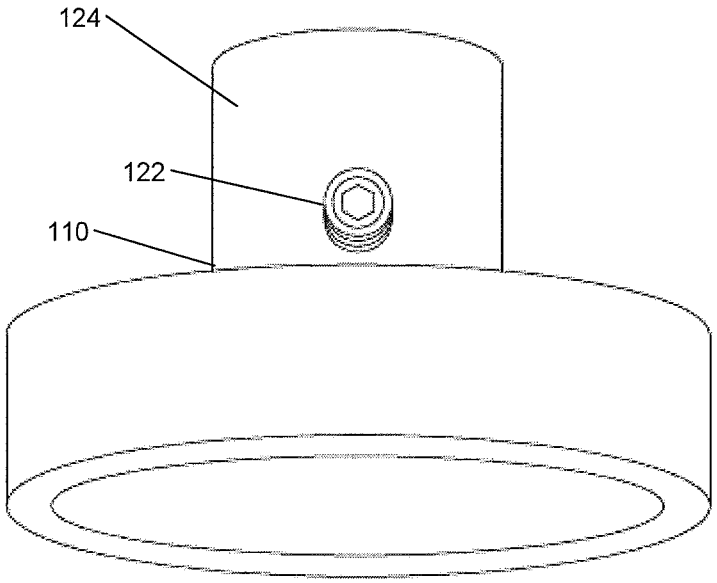
FIG. 11 is a side perspective view of stop wrench of FIG. 10 illustrating a set screw in a rounded base in accordance with an embodiment of the present disclosure.
Figure 12:
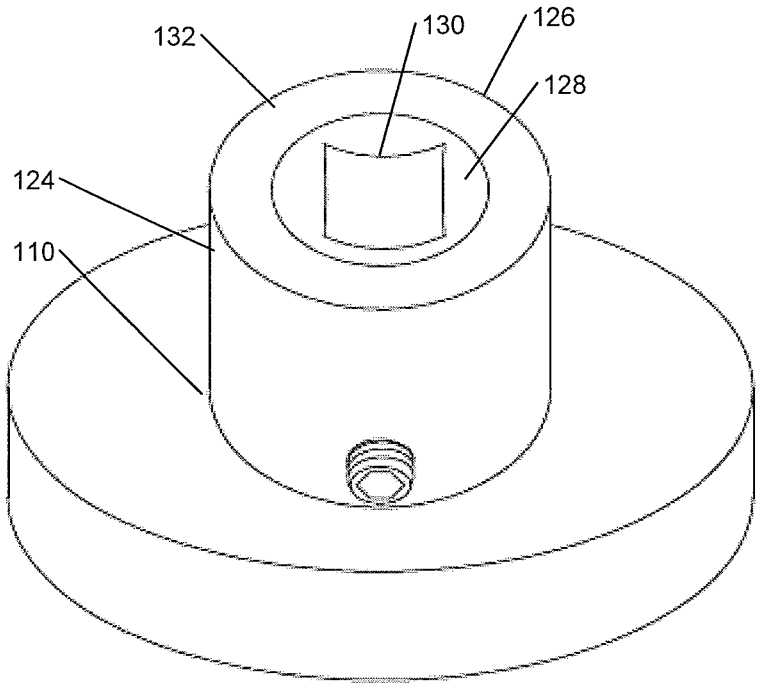
FIG. 12 is another perspective view of the stop wrench of FIG. 10 illustrating a ratchet socket wrench receiving end in accordance with an embodiment of the present disclosure.

The base 56 may be hexagonally-shaped as shown or may have another shape. A circular-shaped base is shown in FIGS. 11-12. When hexagonally-shaped, the base 56 is configured to be inserted into a socket (e.g., socket 58) of a ratchet socket wrench (e.g., ratchet socket wrench 60). In one embodiment, the base 56 fits a ⅞ inch socket or box wrench. The base 56 may be sized to fit sockets and box wrenches of other sizes. The base 56 may be configured to receive an extension (e.g., extension 62) or the square-shaped connecting end (e.g., square-shaped connecting end 63) of a gear component of the ratchet socket wrench 60. In one embodiment, the base 56 is configured to receive a ⅜ inch square extension or ratchet socket wrenches. In other embodiments, the base 56 is configured to receive other sized square extensions or ratchet wrenches. The ratchet socket wrench may include a pivoted bar (or pawl) adapted to engage with teeth of a ratchet wheel. The base 56 may also and/or alternatively be rotated using a pipe wrench, pliers, channel locks or other suitable tool by applying the tool on the outside of the base 56. In one embodiment, the handle receiver 54 and the base 56 are integrally formed as a unitary component.

Figure 4:
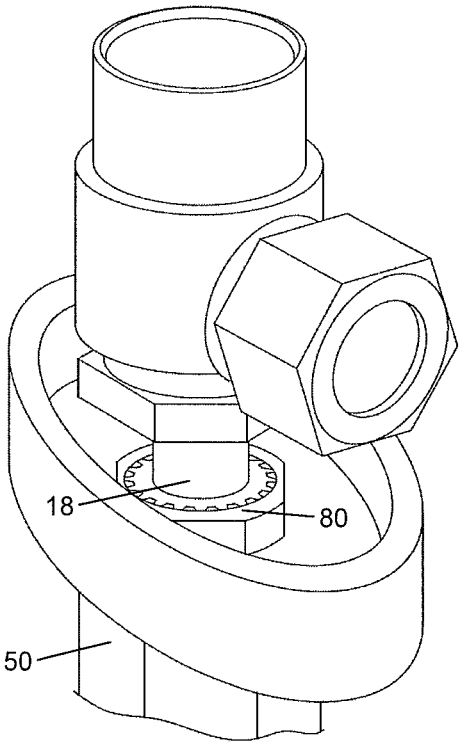
FIG. 4 is a perspective view of the stop wrench of FIG. 2 including a stem adaptor receiving a splined end of a stem of the stop valve in accordance with another embodiment of the present disclosure.
Figure 5:
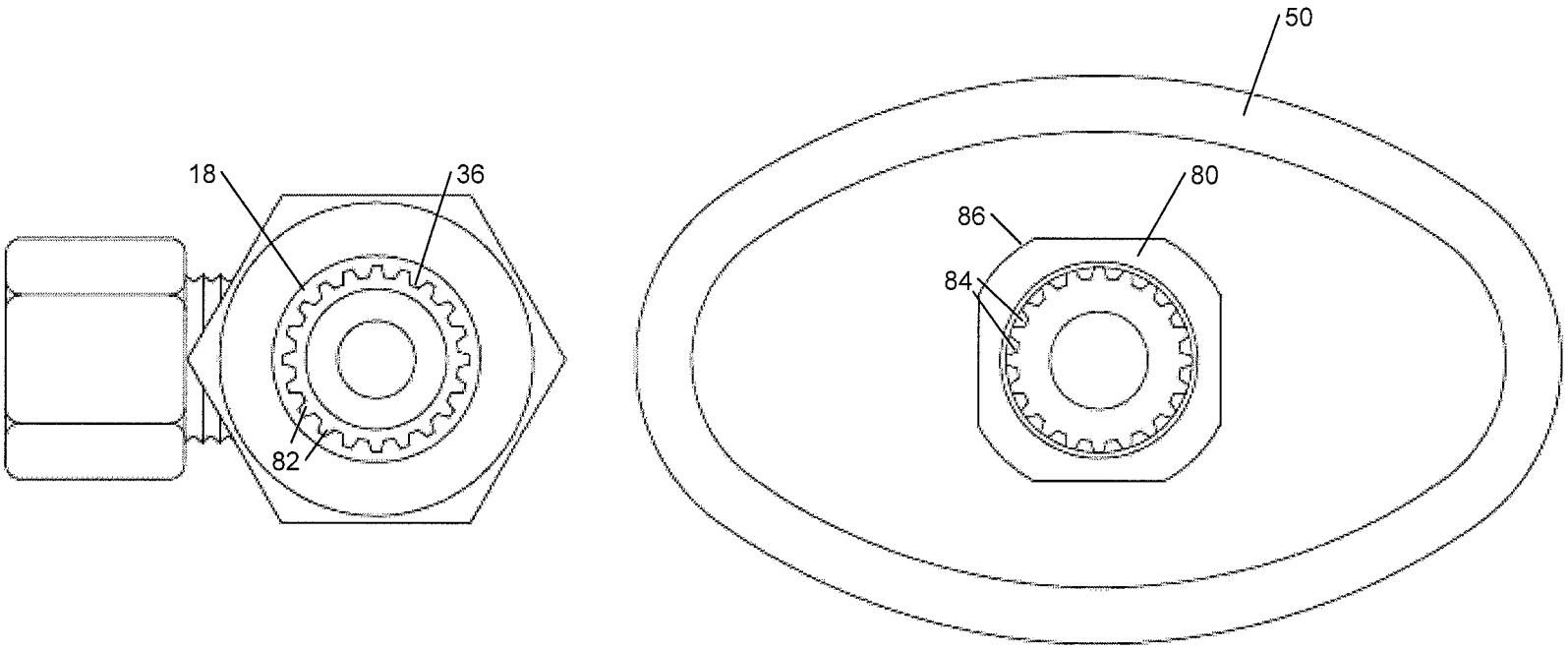
FIG. 5 is a perspective end view of the stop valve and the stop wrench including the stem adaptor of FIG. 4.

FIG. 3 shows the stop wrench 50 including the handle receiver 54. A handle 28 of the stop valve 10 of FIG. 1 is shown in the stop wrench 50. As shown, the stem 18 of the stop valve 10 includes the broach spline 36, which is received in center portion of the handle 28. The stem 18 also includes inner threads for laterally receiving the screw (or fastener) 30 of FIG. 1. As an example, the screw 30 may be formed of steel. Referring also to FIGS. 4-5, the stop wrench 50 may include a stem adaptor 80 receiving the broach spline 36 (or a splined end) of the stem 18. The broach spline 36 has ridges (or teeth) 82 that are slid into grooves 84 in the stem adaptor 80. As shown, the stop wrench 50 includes a hole 86 in which the stem adaptor 80 is inserted. The hole 86 may be square-shaped and/or shaped to match an outer shape of the stem adaptor 80. The stem adaptor 80 is used in the stop wrench 50 when a handle of a stop valve 50 has been removed from the stop valve 50. A handle may be removed when the handle is bent, stripped, broken, etc.

Referring again to FIG. 1, when the handle 28 is fully in the handle receiver 54, there is clearance between (i) a supply nut 16 and (ii) the handle 28 and the handle receiver 54. The stem 18 holds the handle 28 away from the supply nut 16. This clearance may be for example 0.5 inches. An example of the clearance between the handle 28 and the supply nut 16 is shown as C1 in FIG. 1. When the handle 28 is removed and the stem 18 is fully inserted in the stem adaptor 80 and the stem adaptor 80 is fully inserted in the stop wrench 50, there is clearance between the handle receiver 54 and the supply nut 16. An example of the clearance between the handle receiver 54 and the supply nut 16 is shown as C2 in FIG. 2. In one embodiment, C2 is 0.25 inches. The stated clearances allow the stop wrench 50 to be rotated without hitting the supply nut 16.

Figure 6A:
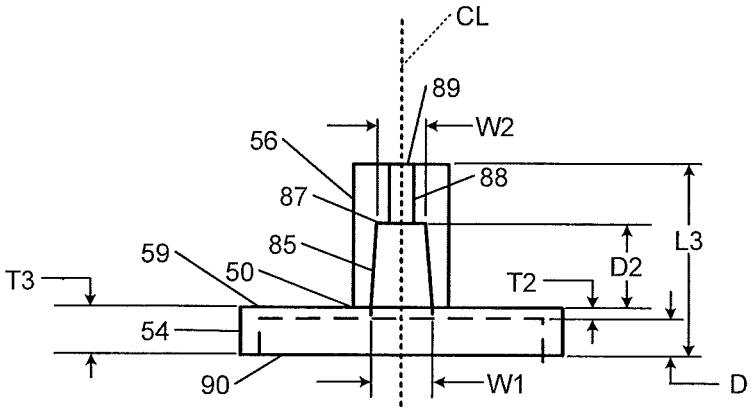
FIG. 6A is a side view of the stop wrench of FIG. 2 illustrating a tapered hole for receiving the stem adaptor in accordance with an embodiment of the present disclosure.
Figure 6B:
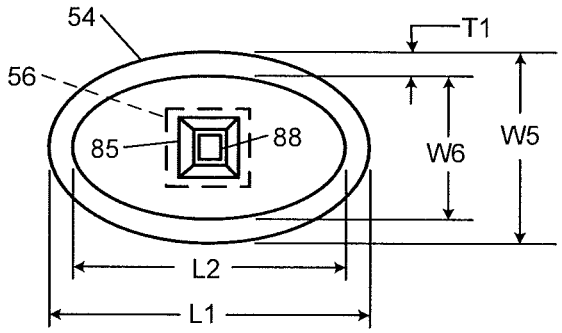
FIG. 6B is an end view of the stop wrench of FIG. 2 illustrating the tapered hole for receiving the stem adaptor.

FIGS. 6A and 6B show side and end views of the stop wrench 50 of FIG. 2 illustrating a tapered hole 85 for receiving the stem adaptor 80 and a second hole 88 for receiving an extension (e.g., the extension 62) and a square-shaped connecting end of a gear component of a ratchet socket wrench (e.g., the square-shaped connecting end of a gear component of the ratchet socket wrench 60). The tapered hole 85 extends through the back plate 59 and into the base 56. A shoulder 87 exists at a plane passing laterally through inner edges of the holes 85, 88 due to the opening of the tapered hole 85 being larger than the opening of the second hole 88. The holes 85, 88 are centered on a centerline CL of the stop wrench 50. The centerline CL extends longitudinally through a center of the stop wrench 50, parallel to the shaft 56 and perpendicular to the back plate 59.

The tapered hole 85 is tapered inward from the handle receiver 54 to the second hole 88, such that an opening at a first end of the tapered hole 85 near the handle receiver 54 is larger than an opening at a second end of the tapered hole 85 near the second hole 88. Although not shown in FIG. 6, an outside end 89 of the second hole 88 that is furthest away from the handle receiver 54 may have a recessed portion as shown in FIG. 12.

Figure 8:
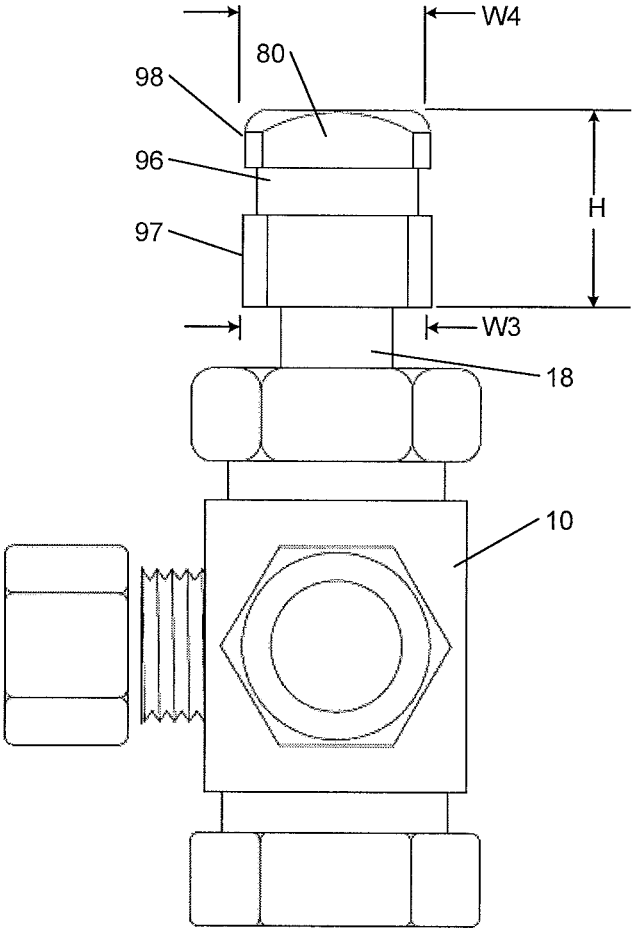
FIG. 8 is a perspective view of the stem adaptor on the stem of the stop valve.

In one embodiment, the tapered hole 85 is 0.68 inches±3% deep, has a first opening width W1 of 0.63 inches and a second opening width W2 of 0.57 inches±3%. The stated sizes of the widths W1, W2 may be to accommodate a stem adaptor having corresponding widths W3 and W4, which are shown in FIG. 8. In an embodiment, the width W3 is 0.58 inches±3%, the width W4 is 0.52 inches±3% and a height H of the stem adaptor is ⅝$^{th}$ inches±3%.

Figure 15:
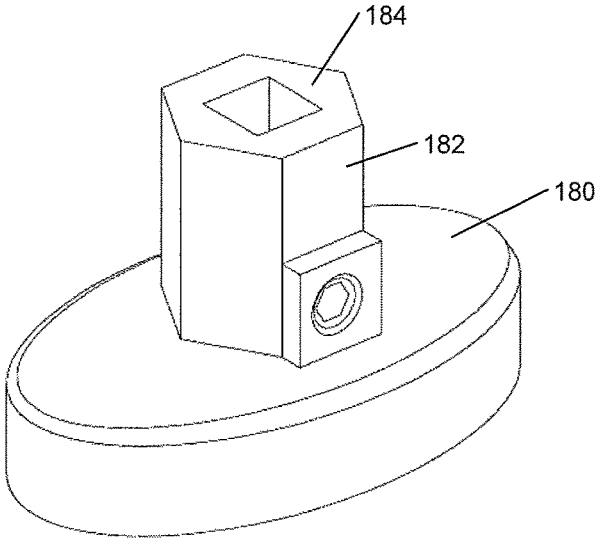
FIG. 15 is a perspective view of another example of a stop wrench having a shortened base with a flat base end in accordance with another embodiment of the present disclosure.

In an embodiment, an overall length L3 of the stop wrench 50 from the outside end 89 at an opening of the base 56 to a handle receiving end 90 at an opening of the handle receiver 54 is 1.91 inches±3%. In another embodiment, the overall length (or height) L3 is 1.61 inches±3%. An example of the shortened based is shown in FIG. 15. In an embodiment, an overall length L1 of the handle receiver 54 is 2.38 inches±3% and an inner length L2 of the handle receiver 54 is 2.11 inches±3%. In an embodiment, an overall width W5 of the handle receiver is 1.48 inches±3% and an inner width W6 of the handle receiver is 1.16 inches±3%, as shown in FIG. 6B.

In an embodiment, the depth D of the handle receiver 54 and a thickness T2 of the back plate 59 are shown. In one embodiment, the thickness T2 of the back plate 59 is 0.14 inches±3%. Thus, the thickness T2 may be different than the thickness T1 of the handle receiver 54. In one embodiment, the thickness T1 is uniform about the handle receiving end 90 of the handle receiver 54. As an example, the thickness T1 may be 0.17 inches±3%. In another embodiment, the thickness T1 is not uniform about the handle receiving end 90 of the handle receiver 54. A thickness T3 of the receiver 54 is also shown and may be equal to a sum of T2 and D.

Figure 7:
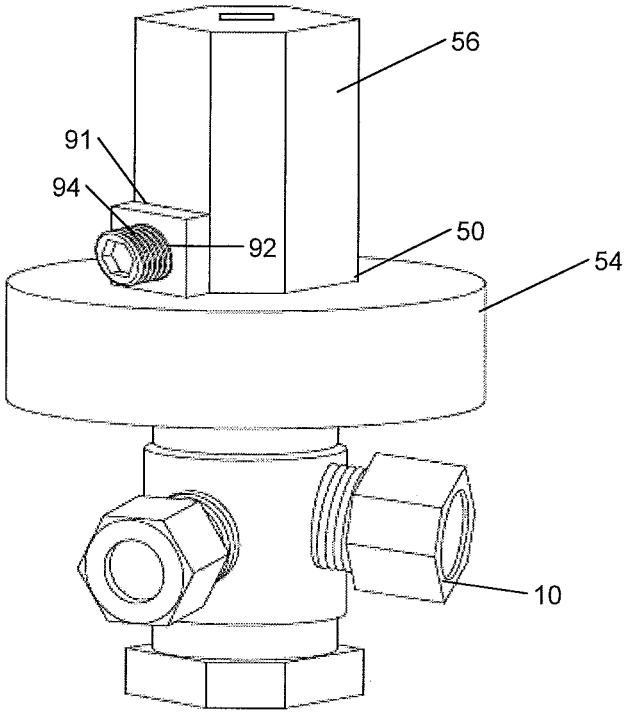
FIG. 7 is another perspective view of the stop wrench of FIG. 2 illustrating a set screw for retaining the stem adaptor in accordance with another embodiment of the present disclosure.

FIG. 7 shows the stop wrench 50 on the stop valve 10. The stop wrench 50 includes an outwardly protruding element 91 (or "bump-out"). The outwardly protruding element 91 includes a threaded hole 92 that receives a screw 94 (e.g., a set screw or thumb screw). The screw 94 is shown as a set screw and is threaded radially into the hole 92 and retains a stem adaptor (e.g., the stem adaptor 80 of FIG. 5) in the stop wrench 50. In an embodiment, the outwardly protruding element 91 is integrally formed with the base 56 and/or handle receiver 54. In another embodiment, the outwardly protruding element 91 is 0.10 inches±3% thick, which defines how much the outwardly protruding element 91 protrudes from the base 56. In an embodiment, the outwardly protruding element 91 extends 0.51 inches±3% from the handle receiver 54 and is 0.38 inches±3% wide. The hole 92 extends through a side wall of the base 56 to a center opening in the base 56. This allows the screw 94 to be threaded through the side wall of the base 56 and into the center opening to contact the stem adaptor 80. The screw 94 may be received in a groove 96 of the stem adaptor 80, as shown in FIG. 8. In FIG. 8, the stem adaptor 80 is shown on the stem 18 of the stop valve 10. In one embodiment, the set screw is a ¼-20 set screw. The groove separates a first tapered portion 97 that receives the stem 18 of the valve 10 from a second tapered portion 98.

FIG. 9 shows an example of the stop wrench 50 having the handle receiver 54 in which the handle 28 of the stop valve 10 is received. In the example shown, the handle receiver 54 is sized to receive the handle 28. In one embodiment, the inner perimeter of the handle receiver 54 is larger than the outer perimeter of the handle 28 by a predetermined amount (e.g., 3%) to assure a minimal clearance between the handle 28 and the outer side wall 57 of the handle receiver 54. The inner perimeter of the handle receiver 54 may be shaped similar to the handle 28. An outer perimeter of the handle receiver 54 may be shaped similar to the inner perimeter of the handle receiver 54 or may be shaped differently. The outer side wall 57 extends circumferentially around the handle 28. In another embodiment, the outer side wall 57 is over sized to be larger than the handle 28 by more than the predetermined amount. In another embodiment, a clearance gap G between the handle 28 and the outer side wall 57 is uniform around the perimeter of the handle 28. In yet another embodiment, the clearance gap G between the handle 28 and the outer side wall 57 is not uniform. An example of this is shown in FIG. 9. In FIG. 9, grooves 100 in a center portion 102 of the handle 28 are shown for receiving teeth of the broach spline 36.

FIG. 10 shows another stop wrench 110 having a handle receiver 112 in which a handle 114 (e.g., the handle 28) of a stop valve is received. The handle receiver 112 is oversized at least in predetermined areas of the stop wrench 110. In the example shown, the handle receiver 112 is oversized and has a rectangular/oval shaped interior with "four corners" identified as 116. The four corners 116 are not 90° corners, but rather are rounded obtuse angled corners. Gaps between the handle 28 and the handle receiver 112 increase in areas of the four corners 116. This is also an example of clearance between a handle and a handle receiver not being uniform around a perimeter of the handle.

FIG. 11 shows a stop wrench 110 of FIG. 10 illustrating a set screw 122 in a rounded base (or shaft) 124. The set screw 122 has a hexagonally-shaped interior to receive, for example, an allen wrench. FIG. 12 shows the stop wrench 110 illustrating a ratchet receiving end 126. The ratchet receiving end 126 includes a recessed portion 128 and a hole 130 for receiving an extension (e.g., the extension 62 of FIG. 2) or square-shaped connecting end of a gear component of the ratchet socket wrench on which a socket may attach. The hole 130 is shown as being square shaped, but may be another shape. Entrance of the hole 130 is recessed from the end surface 132 of the base 124. The entrance of the hole 130 may be for example 0.100 inches longitudinally inward from the end surface 132. The recessed portion 128 is cupped and angled from an outer edge inward towards the hole 130 to aid in guiding the extension and square-shaped connecting end of a gear component of the ratchet socket wrench into the hole 130.

Figure 13:
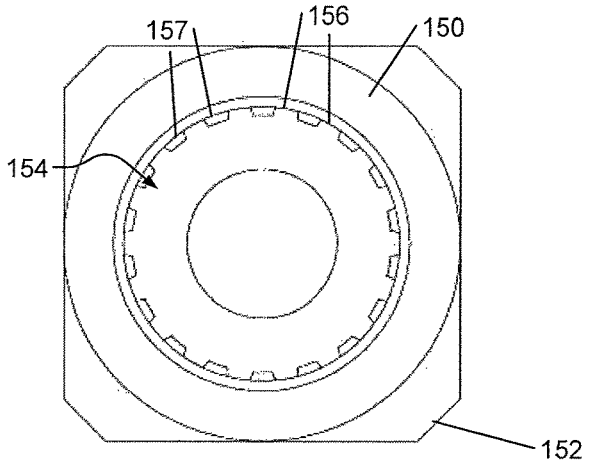
FIG. 13 is an end view of an example of a fine stem adaptor.
Figure 14:
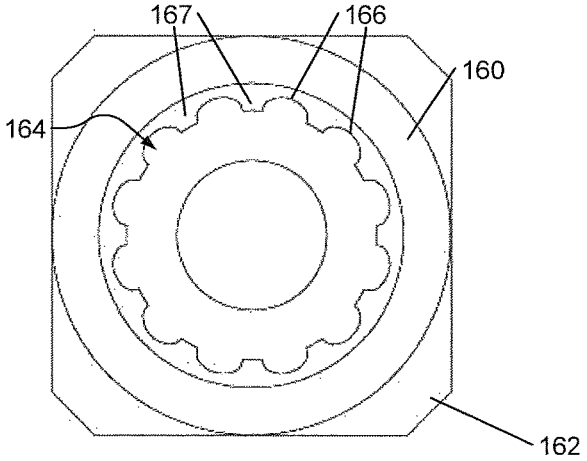
FIG. 14 is an end view of an example of a course stem adaptor.

FIG. 13 shows an example of a fine stem adaptor 150 that includes a body 152 having a center hole 154 with grooves 156 between teeth 157. The grooves 156 are arranged in a fine pattern to receive a broach spline of a stem of a stop valve having a corresponding fine pattern of teeth. As another example, FIG. 14 shows an example of a course stem adaptor 160 that includes a body 162 having a center hole 164 with grooves 166 between teeth 167. The grooves 166 are arranged in a course pattern to receive a broach spline of a stem of a stop valve having a corresponding course pattern of teeth. Although the grooves 166 are shown as being rounded, the grooves may be triangular shaped. As can be seen from FIGS. 13 and 14, the course stem adaptor 160 has fewer grooves and teeth than the fine stem adaptor 150. The outer dimensions of the adaptors 150, 160 and the inner diameters of the holes 154, 164 may be the same. Both of the adaptors 150, 160 may be used in, for example, the stop wrench 50 of FIG. 2 and/or in other stop wrenches disclosed herein.

Different stem adaptors (also referred to as inserts) may be used with the stop wrenches disclosed herein. The stem adaptors may have the same outer dimensions, but may have different inner dimensions to accommodate different broach splines of different stop valves. This allows each of the different stem adaptors to fit different stop wrenches.

FIG. 15 shows another example of a stop wrench 180 having a shortened base 182 with a flat base end 184. A length of the shortened base 182 is less than a length of the base 56 of FIG. 2. The shortened base 182 can allow the stop wrench 180 to be used in tight locations where there is limited available space for the stop wrench and/or for a tool (e.g., a ratchet socket wrench) to turn the stop wrench. In this example, the flat base end 184 does not include a recessed portion as shown in FIG. 12. In another embodiment, the base 182 does include a recessed portion.

Figure 16:
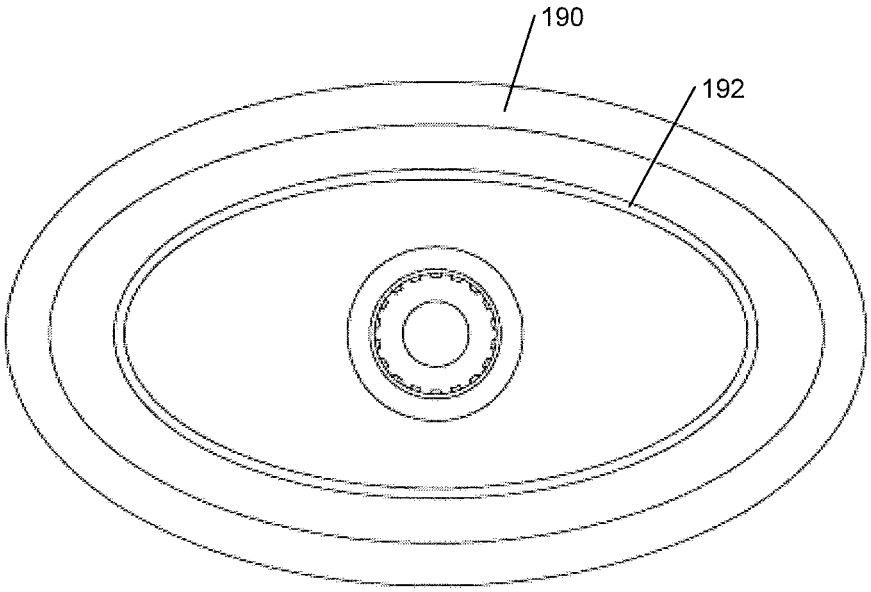
FIG. 16 is a perspective view of an example of a stop wrench oversized for a handle of a first type in accordance with an embodiment of the present disclosure.
Figure 17:
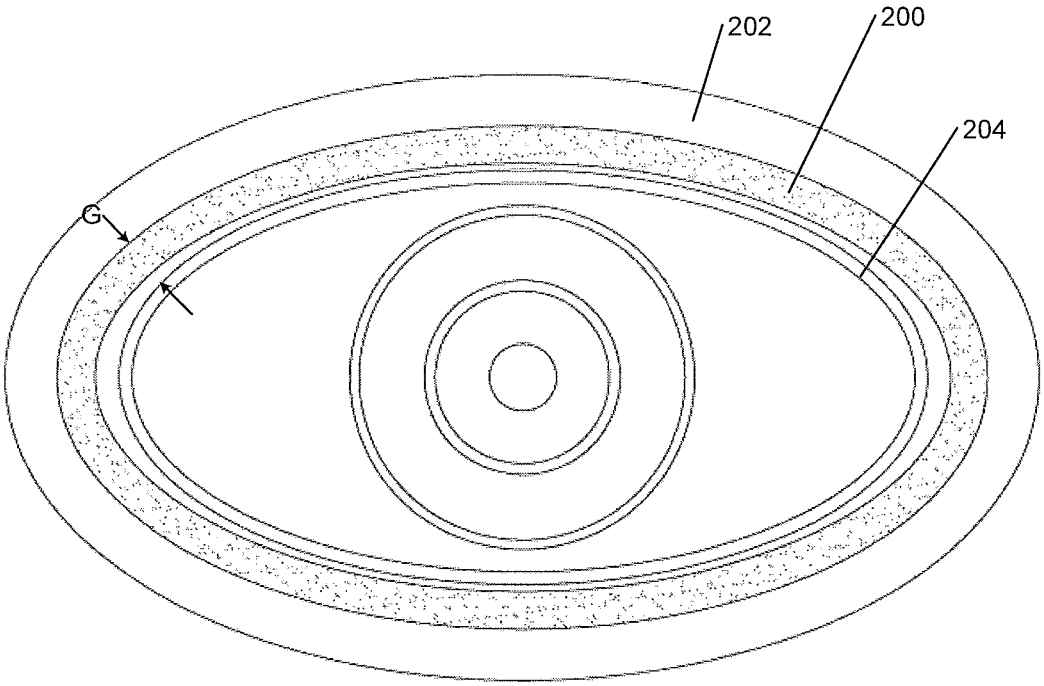
FIG. 17 is a perspective view of the stop wrench of FIG. 16 illustrating a handle adaptor in accordance with an embodiment of the present disclosure.
Figure 18:
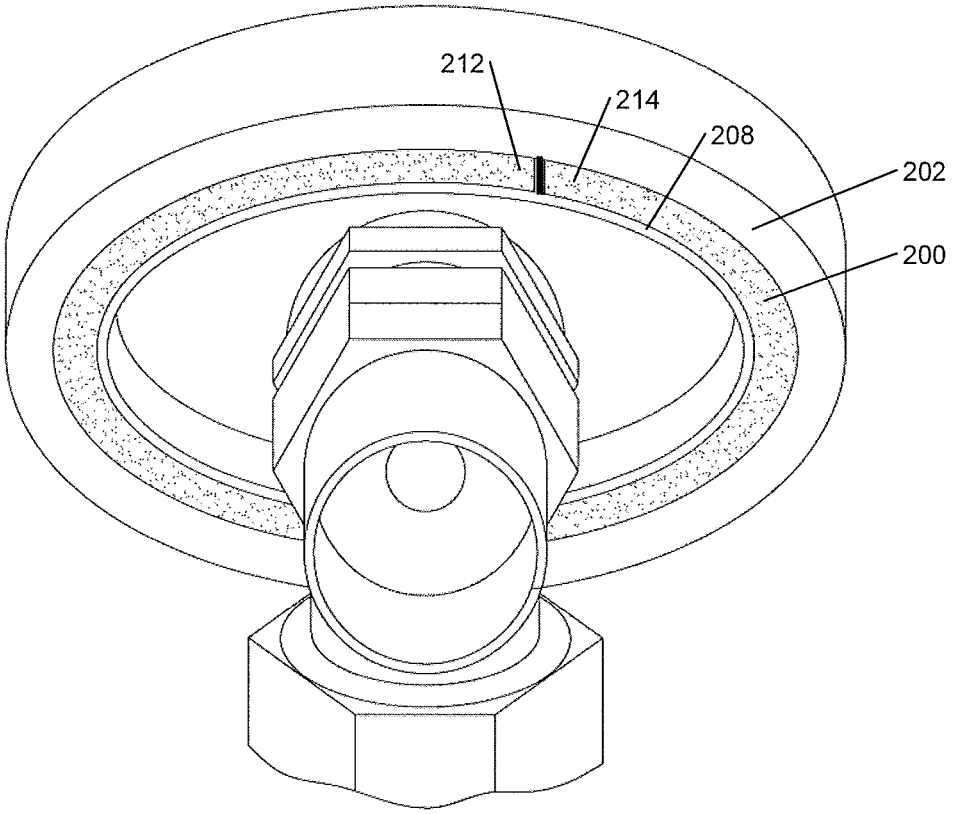
FIG. 18 is a perspective view of an example of the stop wrench of FIG. 16 and handle adaptor sized for a handle of a second type in accordance with an embodiment of the present disclosure.
Figure 19:
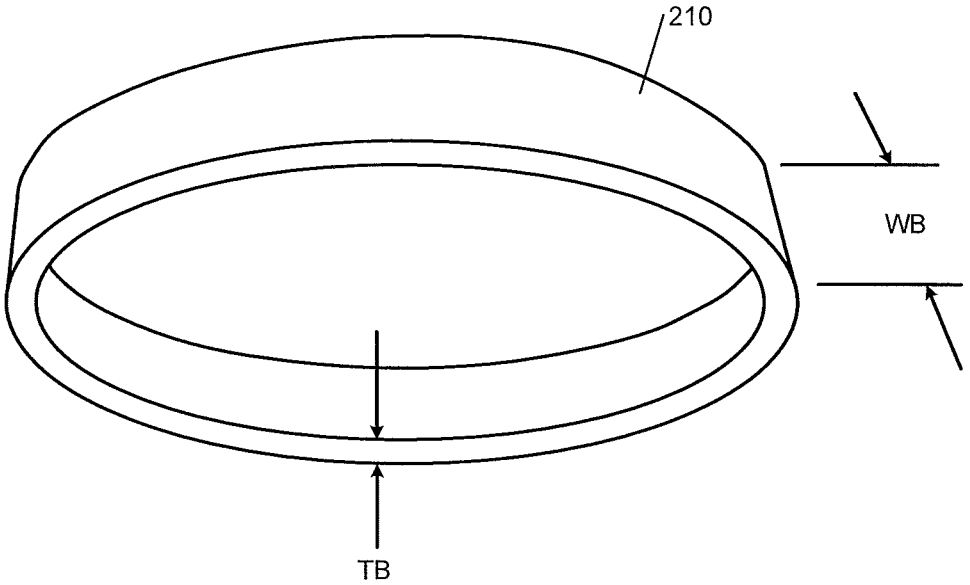
FIG. 19 is a perspective view of another handle adaptor in accordance with an embodiment of the present disclosure.

FIG. 16 shows an example of a stop wrench 190 oversized for a handle 192 of a first type. By being oversized, the stop wrench 190 may be used on multiple handles of different types, sizes and shapes. The handle 192 is a handle of a stop valve. The stop wrenches disclosed herein may be used on handles that are smaller than the openings of the handle receivers of the stop wrenches. As an alternative, a handle adaptor may be included and inserted in the handle receiver as shown in FIGS. 17-18. An example handle adaptor 200 is shown as a band that is wrapped around the handle of a stop valve and/or inserted in a handle receiver of a stop wrench. The handle adaptor 200 fills in a least a portion of the gap G surrounding the handle. The gap G is and between the handle and the outer side wall of the handle receiver of the stop wrench. FIG. 17 shows the handle adaptor 200 being used between a first stop wrench 202 and a first handle 204. FIG. 18 shows the handle adaptor 200 being used between a second stop wrench 206 and a second handle 208 of a second type. FIG. 19 shows another handle adaptor 210, which is shown as an oval-shaped band.

The handle adaptors 200, 210 may have a width (e.g., width WB) equal to or greater than a depth of a handle receiver of a corresponding stop wrench. By having the width be greater than the depth of the handle receiver, it may be easier to grab and remove the handle adaptors 200, 210 from the handle receiver. The lengths of the handle adaptors 200, 210 when unrolled and measured from one end of the bands to a second end of the bands may match or be smaller than a length of an inner perimeter of the handle receiver. Example band ends are identified as 212 and 214 in FIG. 18. The thicknesses (e.g., thickness TB) of the handle adaptors 200, 210 may be sized to fill in a predetermined percentage of the gap between a handle and a handle receiver. In yet another embodiment, the thickness of a handle adaptor is uniform. In still another embodiment, the thickness of a handle adaptor varies. In one embodiment, the handle adaptor 200 is configured as a strip that may be wrapped around a handle. In another embodiment, the handle adaptor 210 is a continuous circular band. The handle adaptors 200, 210 may be formed of various materials including rubber, plastic, and/or other suitable material. In one embodiment, the handle adaptors 200, 210 are formed of an elastic material.

The handle adaptors 200, 210 may be used, for example, on handles of ¼ turn stop valves that typically include smaller handles than multi-turn stop valves. In one embodiment, the handle adaptors 200, 210 are 0.07±3% inches thick and 0.46±3% inches wide. The handle adaptors 200, 210 may be sized to provide a snug fit between a stop valve handle and a handle receiver of a stop wrench.

Figure 20:
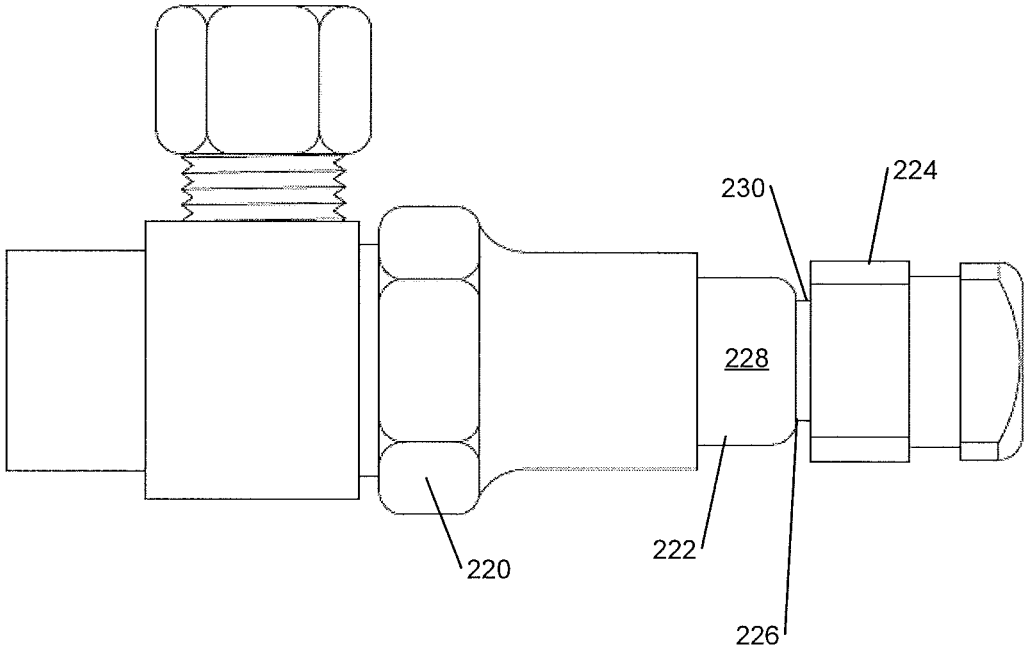
FIG. 20 is a perspective view of is a side perspective view of a tamper resistant stop valve, a tamper resistant stop valve adaptor and stem adaptor in accordance with another embodiment of the present disclosure.
Figure 25:
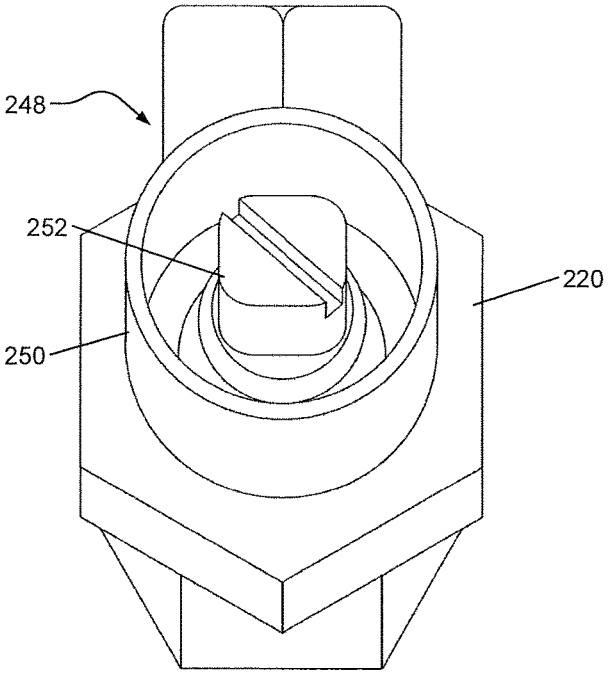
FIG. 25 is another perspective view illustrating a recessed stem of the tamper resistant stop valve of FIG. 20.
Figure 26:
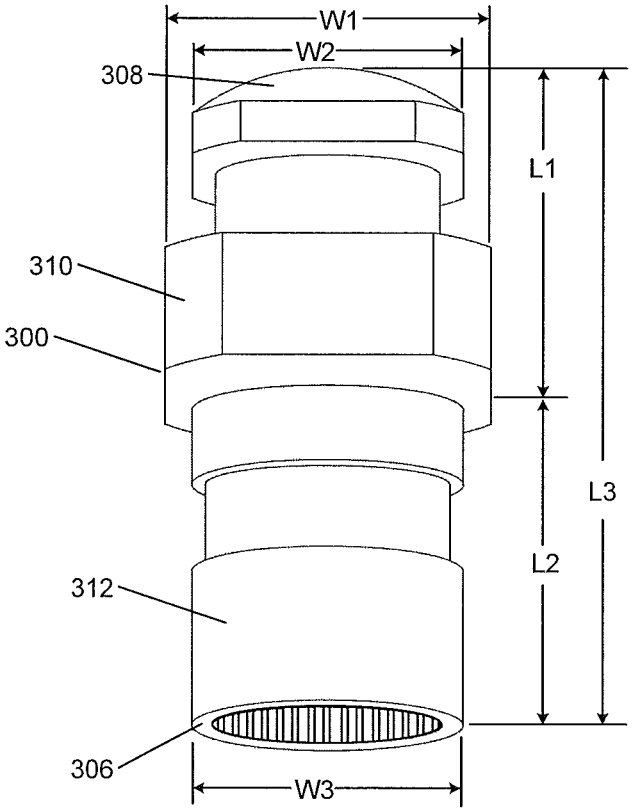
FIG. 26 is a side perspective view of another example stem adaptor including a spline for turning a stem of a tamper resistant stop valve in accordance with an embodiment of the present disclosure.
Figure 27:
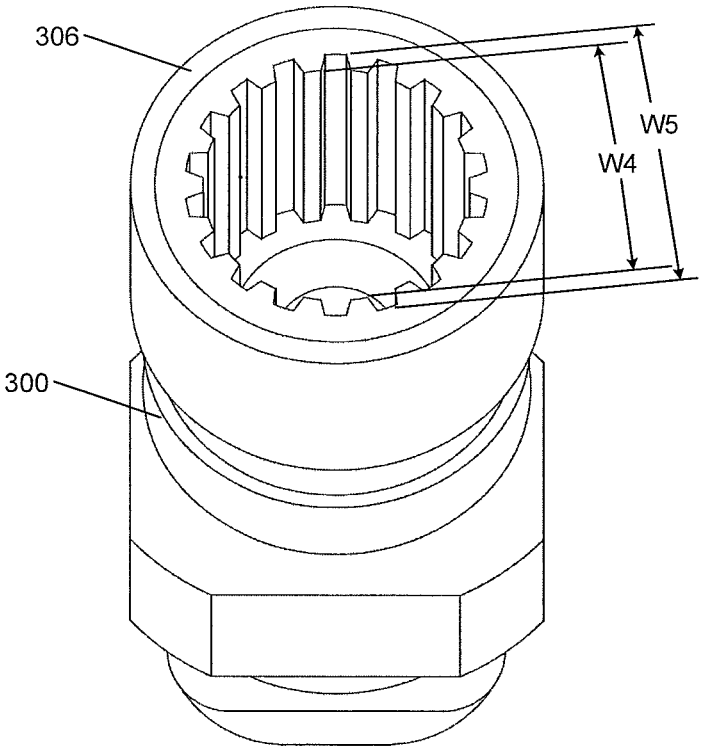
FIG. 27 is a top perspective view of the stem adaptor of FIG. 26.
Figure 28:
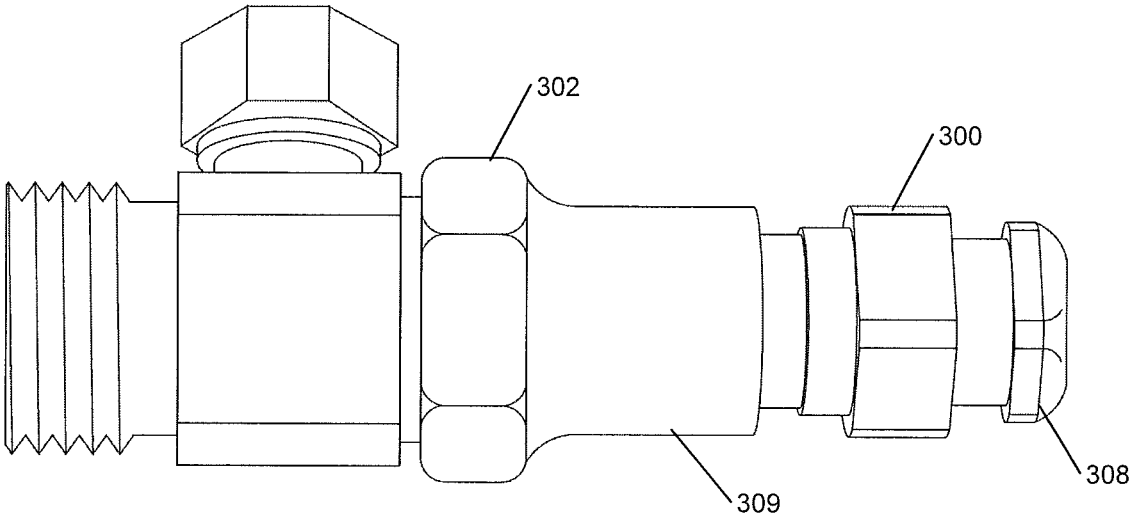
FIG. 28 is a side perspective view of the stem adaptor of FIG. 26 applied on the a tamper resistant stop valve.
Figure 29:
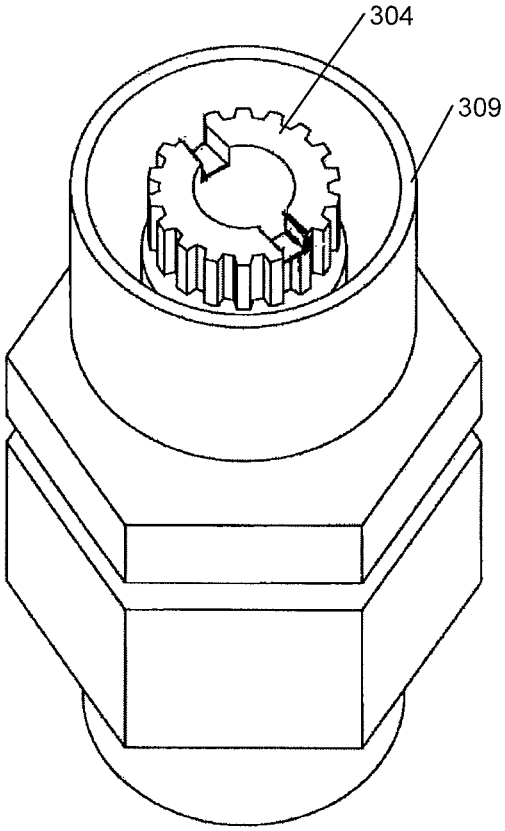
FIG. 29 is a top perspective view of the tamper resistant stop valve of FIG. 28.

FIG. 20 shows a tamper resistant stop valve 220, a tamper resistant stop valve adaptor 222 and stem adaptor 224. The tamper resistant stop valve adaptor 222 allows the stem adaptor 224 to connect to a stem of the tamper resistant stop valve 220. An example stem is shown in FIG. 25. The tamper resistant stop valve adaptor 222 includes a body 226 having a first portion with a cylindrical key 228 and a second portion with a broach spline 230. The broach spline 230 may be configured similar as a broach spline of a stem of a general purpose stop valve. The broach spline 230 is configured to be inserted into and mate with grooves and teeth on an interior of the stem adaptor 224. As an example, the tamper resistant stop valve adaptor 222 may be formed of brass, aluminum or white metal (or zinc).

Figure 21:
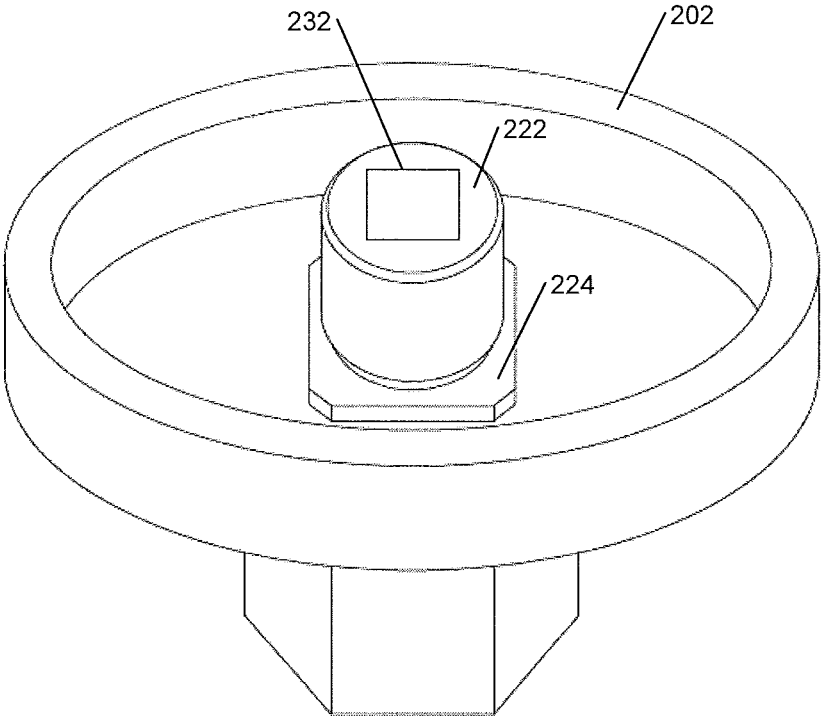
FIG. 21 is a perspective view of the stop wrench of FIG. 16 and the tamper resistant stop valve adaptor and stem adaptor of FIG. 20.

FIG. 21 shows the stop wrench 202 of FIG. 16 and the tamper resistant stop valve adaptor 222 and stem adaptor 224 of FIG. 20. The cylindrical key 228 of the tamper resistant stop valve adaptor 222 includes a square-shaped hole 232 for receiving a stem of the tamper resistant stop valve 220.

Figure 22:
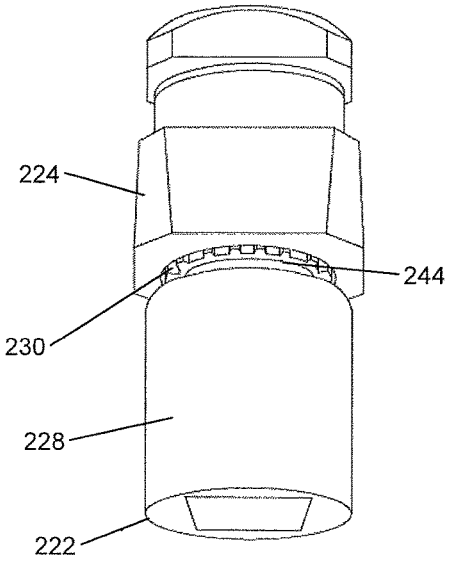
FIG. 22 is a perspective side view of the tamper resistant stop valve adaptor and stem adaptor of FIG. 20.
Figure 23:
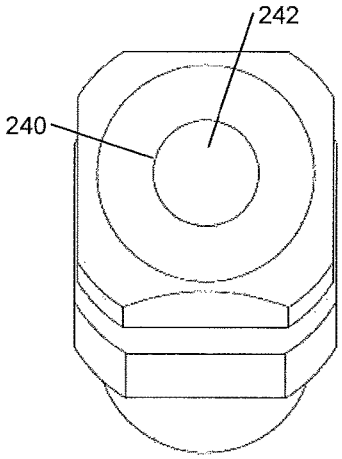
FIG. 23 is another perspective view of the tamper resistant stop valve adaptor and stem adaptor of FIG. 20 illustrating a base end of the stem adaptor.
Figure 24:
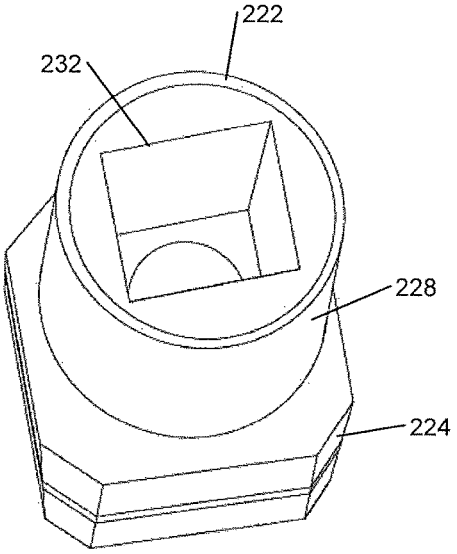
FIG. 24 is another perspective view of the tamper resistant stop valve adaptor and stem adaptor of FIG. 20 illustrating a keyed receiving end of the tamper resistant stop valve adaptor in accordance with an embodiment of the present disclosure.

FIGS. 22 and 24 show the tamper resistant stop valve adaptor 222 and stem adaptor 224 of FIG. 20. The tamper resistant stop valve adaptor 222 includes the cylindrical key 228 and the broach spline 230. FIG. 23 shows an end of the stem adaptor 224 along with the tamper resistant stop valve adaptor 222 of FIG. 20. The stem adaptor 224 may have an access hole 240 at an end furthest from the tamper resistant stop valve adaptor 222. The access hole 240 eases removal of the stem adaptor 224 from the temper resistant stop valve adaptor 222 and allows a tool to be inserted into the stem adaptor 224 to push an end 242 having the broach spline 230 of the tamper resistant stop valve adaptor 222 out of the stem adaptor 224.

Although the broach spline 230 is not fully shown in FIG. 22, the broach spline 230 may be configured similarly as the broach spline of a stem of a stop valve (e.g., the broach spline 36 of the stem 18 of the stop valve 10 of FIG. 1). The outer diameter of the broach spline 230 may be different than the outer diameter of the cylindrical key 228. A shaft 244 may be disposed between the cylindrical key 228 and the broach spline 230, as seen in FIG. 21. In one embodiment, the stem adaptor 224 and the cylindrical key 228 are integrally formed as a single part and do not include the broach spline 230 and/or shaft 244. An example of a combined tamper resistant stop valve and stem adaptor, which is a single part, is shown in FIG. 30 and described below.

Referring now also to FIG. 25, which shows the tamper resistant stop valve 220 of FIG. 20 illustrating a receiving end 248 of the tamper resistant stop valve 220. The receiving end 248 includes an outer cylindrical wall 250. The stem 252 of the tamper resistant stop valve 220 extends through a center of and does not contact the outer cylindrical wall 250 such that there is a gap between the stem 252 and the outer cylindrical wall 250. The cylindrical key 228 of the tamper resistant stop valve adaptor 222 is received in the gap between the stem 252 and the outer cylindrical wall 250. The stem 252 may be recessed such that an end of the stem 252 that contacts the cylindrical key 228 is within the outer cylindrical wall 250. Although the outer cylindrical wall 250 and the outer surface of the cylindrical key 228 are shown as having a matching circular-shape, these elements may have a different matching shape. Also, although the stem 252 and the hole 232 are shown as having a matching square-shape, these elements may have a different matching shape.

FIGS. 26-29 show another stem adaptor 300 for another type of tamper resistant stop valve 302. The stem adaptor 300 is configured to fit in any of the stop wrenches disclosed herein similar as the stem adaptor 80 of FIG. 8. The tamper resistant stop valve includes a splined stem 304 that is received within a grooved end 306 of the stem adaptor 300. The other end 308 of the stem adaptor 300 is received within a stop wrench. The grooved end 306 is received in cylindrical guard 309 of the stop valve 302.

As an example, a first portion 310 of the stem adaptor 300 that is received within a stop wrench may be 0.625±3% inches in length (indicated as L1). A second portion 312 of the stem adaptor 300 that receives the stem 304 may also be 0.63±3% inches in length (indicated as L2) providing an overall length L3 of the stem adaptor 300 of 1.25 inches. A first width W1 of a beveled end of the first portion 310 may be 0.52±3% inches. A second width W2 of the first portion 310 may be 0.58±3% inches. A third width (or outer diameter) W3 of the second portion 312 may be 0.53±3% inches. A fourth width W4 between peaks of opposing teeth in the second portion 312 may be 0.37±3%. A fifth width W5 between bases of the opposing teeth in the second portion 312 may be 0.39±3%. In this example, a thickness of a wall of the second portion 312, not including height of the teeth, may be 0.07 inches. As an example, the splined stem 304 may include as an example 18 teeth (or points) or another number of teeth. In one embodiment, the first portion 310 and the second portion 312 are integrally formed as a single part. In another embodiment, the first portion 310 is formed separately from the second portion 312. For this embodiment, the end of the first portion 310 nearest the second portion 312 includes grooves that receive a broach spline on an end of the second portion 312. The broach splined end of the second portion 312 is different than the grooved end 306. When formed as a single part, the first portion 310 does not include grooves for a spline and the second portion 312 does not include a spline to connect to the first portion 310.

FIG. 30 shows a combined tamper resistant stop valve and stem adaptor 350 which includes a stem adaptor portion 352 and a tamper resistant stop valve portion 354, which may be connected via a shaft 356. As an example, the stem adaptor portion 352 that is received within a stop wrench may be 0.635±3% inches in length (indicated as L1). The tamper resistant stop valve portion 354 may also be 0.635±3% inches in length (indicated as L2) providing an overall length L3 of the combined tamper resistant stop valve portion 354 and stem adaptor portion 352 of 1.25 inches. A first width W1 of a beveled end of the stem adaptor portion 352 may be 0.59±3% inches. A second width W2 of the stem adaptor portion 352 may be 0.53±3% inches. A third width (or outer diameter) W3 of the tamper resistant stop valve portion 354 may be 0.53±3% inches, but may vary in sizes as may other dimensions disclosed herein. A fourth width of the square-shaped hole 356 may be, for example 0.30±3% inches.

The stop wrenches disclosed herein may be formed of: cast iron; aluminum; brass; bronze; plastic including, for example acrylonitrile butadiene styrene (ABS) and/or polyvinyl chloride (PVC); carbon fiber; and/or other suitable materials.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A stop wrench comprising:

a handle receiver comprising an outer wall and a back plate, wherein the handle receiver is configured to receive a handle of a first stop valve within the outer wall, wherein the handle abuts the back plate when fully in the handle receiver;

a base attached to the handle receiver and extending from the back plate, wherein the base is configured to be rotated via a tool, and wherein rotation of the base rotates the handle receiver, which in turn rotates the handle to open or close the first stop valve; and a first hole configured to receive a stem adaptor.

2. The stop wrench of claim 1, wherein the first hole extends through the back plate and into the base.

3. The stop wrench of claim 2, wherein the first hole is tapered, such that a first opening of a first end of the first hole nearest the handle receiver is larger than a second opening of a second end of the first hole furthest away from the handle receiver.

4. The stop wrench of claim 2, further comprising a second hole that extends from an end of the base furthest away from the handle receiver and towards the first hole, wherein the first hole and the second hole are centered on a same centerline of the stop wrench.

5. The stop wrench of claim 4, the second hole is configured to a portion of a ratchet socket wrench.

6. The stop wrench of claim 1, wherein an end of the base furthest away from the handle receiver and is configured to receive a portion of a ratchet socket wrench.

7. The stop wrench of claim 6, wherein a portion of the end of the base furthest away from the handle receiver is recessed to guide the portion of the ratchet socket wrench into the base.

8. The stop wrench of claim 1, wherein the handle receiver is cup-shaped to hold and turn the handle of the first stop valve.

9. An assembly comprising:

the stop wrench of claim 1;

the stem adaptor; and a fastener configured to hold the stem adaptor in the stop wrench.

10. The assembly of claim 9, further comprising a tamper resistant stop valve adaptor comprising:

a key configured to receive a second stem of a tamper resistant stop valve; and a broach spline configured to be received in the stem adaptor.

11. A stop wrench comprising:

a handle receiver comprising an outer wall and a back plate, wherein the handle receiver is configured to receive a handle of a first stop valve within the outer wall, wherein the handle abuts the back plate when fully in the handle receiver; and a base attached to the handle receiver and extending from the back plate, wherein the base is configured to be rotated via a tool, wherein rotation of the base rotates the handle receiver, which in turn rotates the handle to open or close the first stop valve, and wherein the base is hexagonally-shaped.

12. A stop wrench comprising:

a handle receiver comprising an outer wall and a back plate, wherein the handle receiver is configured to receive a handle of a first stop valve within the outer wall, wherein the handle abuts the back plate when fully in the handle receiver, and wherein the handle receiver is oversized for the handle of the first stop valve; and a base attached to the handle receiver and extending from the back plate, wherein the base is configured to be rotated via a tool, and wherein rotation of the base rotates the handle receiver, which in turn rotates the handle to open or close the first stop valve.

13. An assembly comprising:

a stop wrench comprising a handle receiver comprising an outer wall and a back plate, wherein the handle receiver is configured to receive a handle of a first stop valve within the outer wall, wherein the handle abuts the back plate when fully in the handle receiver, and a base attached to the handle receiver and extending from the back plate, wherein the base is configured to be rotated via a tool, and wherein rotation of the base rotates the handle receiver, which in turn rotates the handle to open or close the first stop valve; and a handle adaptor configured to fill at least a portion of a gap between the handle and the outer wall of the handle receiver.

14. A stop wrench comprising:

a handle receiver comprising an outer wall and a back plate, wherein the handle receiver is configured to be applied one-at-a-time on to a plurality of different types of handles of a plurality of different types of stop valves such that when applied to one of the handles, the one of the handles is disposed within a perimeter of the outer wall; and a base attached to the handle receiver and extending from a center of the back plate, wherein the base is configured to be rotated via a tool, wherein rotation of the base rotates the handle receiver, which in turn rotates the handle to open or close the stop valve on which the handle receiver is applied, and wherein at least one of the back plate or the base is configured to be coupled to a stem of at least one of the plurality of different types of stop valves.

15. The stop wrench of claim 14, wherein the base comprises:

a first hole configured to receive a portion of a ratchet socket wrench; and a second hole configured to receive a stem adaptor, wherein the base is configured to be coupled to the stem, and wherein the stop valve, on which the handle receiver is applied via the stem adaptor, comprises the stem.

16. The stop wrench of claim 15, further comprising a fastener, wherein the base comprises a third hole configured to receive the fastener, and wherein the fastener holds the stem adaptor to the base.

17. The stop wrench of claim 16, wherein the fastener is a set screw that is threaded into a side of the base and extends radially into the first hole and into a groove in the stem adaptor.

18. A tamper resistant stop valve adaptor comprising:

a body;

a cylindrical key at one end of the body and configured to receive a stem of a tamper resistant stop valve; and a broach spline at a second end of the body and configured to mate with grooves and teeth in a stem adaptor, wherein, when the stem adaptor is rotated by a stop wrench, the cylindrical key is rotated by the stem adaptor and as a result rotates the stem of the tamper resistant stop valve to open or close the tamper resistant stop valve.

19. The tamper resistant stop valve adaptor of claim 18, wherein:

the cylindrical key is cylindrical-shaped to be received in a circular wall of the tamper resistant stop valve; and the cylindrical key comprises a square-shaped hole configured to receive the stem of the tamper resistant stop valve.

20. An assembly comprising:

the tamper resistant stop valve adaptor of claim 18; and the stop wrench comprising a handle receiver configured to receive a handle of a second stop valve, and a base comprising a hole, wherein the hole is configured to receive the stem adaptor.

* * * * *